United States Patent [19]

Sullivan et al.

[11] 4,170,841

[45] Oct. 16, 1979

[54] KISSING DOLL

[75] Inventors: Paul J. Sullivan, 300 Metacom Ave., Bristol, R.I. 02809; Ernest Bridge, Jr., Woonsocket, R.I.

[73] Assignee: Paul J. Sullivan

[21] Appl. No.: 832,426

[22] Filed: Sep. 12, 1977

[51] Int. Cl.[2] ..... A63H 3/36

[52] U.S. Cl. ..... 46/171; 46/116

[58] Field of Search ..... 46/116, 171, 164, 135 R, 46/1 R, 115, 156

[56] References Cited

U.S. PATENT DOCUMENTS

| | | | |
|---|---|---|---|
| 2,056,405 | 10/1936 | Lewis | 46/156 X |
| 2,781,611 | 2/1957 | Bills et al. | 46/116 X |
| 3,169,343 | 2/1965 | Freimauer et al. | 46/171 X |
| 3,210,884 | 10/1965 | Sharff et al. | 46/22 |
| 3,237,344 | 3/1966 | Ostrander | 46/171 X |
| 4,075,782 | 2/1978 | Neuschatz | 46/135 R X |

*Primary Examiner*—Russell R. Kinsey
*Assistant Examiner*—Mickey Yu
*Attorney, Agent, or Firm*—Salter & Michaelson

[57] ABSTRACT

A doll which is adapted to simulate kissing by leaving a lip imprint of marking material on objects contacted therewith is disclosed. The head of the doll is provided with an inwardly directed cavity in the oral region thereof which in turn is adapted to receive a pad of porous material in which the marking material is impregnated. The end of the pad is provided with a lip shaped extension adapted to project outwardly from the face of the doll so that when the doll's face is impressed against an object, an imprint of marking material in the shape of the lips is produced. In one form of the invention the pad is received in a closed cavity and in an alternate form of the invention the pad is mounted at the forward end of a pushing member slidably mounted in the doll's head so that a more positive "kiss" imprint may be made.

10 Claims, 4 Drawing Figures

KISSING DOLL

BACKGROUND AND SUMMARY OF THE INVENTION

This invention is directed to a doll construction and particularly one in which the doll may simulate a kissing action by leaving a lip imprint of marking material on contacted objects, including other dolls and the children who are playing with them. Children often play by imparting human actions to their dolls, and it is accordingly common for children to impress the lip area of their dolls upon favorite objects including other dolls, pets, parents and even siblings. It is accordingly believed that the play value of such dolls could be materially enhanced if they were capable of imparting physical evidence of such kissing action on such objects.

It is accordingly a primary object of the present invention to provide a doll construction in which a kissing action thereof is positively simulated by leaving a lip imprint on the object contacted.

A still further object of the present invention is the provision of a simulated kissing doll of the aforementioned type in which such action may be accomplished in a simple, straight-forward and relatively inexpensive manner.

A still further object of the present invention is the provision of a simulated kissing doll of the immediately aforementioned type in which the pressure by which such imprint is imparted may be regulated so as to leave a more positive i.e., a darker or firmer imprint on the surfaces contacted.

These and other objects of the present invention are accomplished by a doll in which the face surface thereof includes an inwardly directed cavity in the oral region, which cavity is provided with a pad of porous material in turn impregnated with a fluid marking material. The outer face of the pad is provided with lip extensions which are adapted to outwardly project therefrom and from the adjacent face portions of the doll so that they will contact objects when the doll is placed in a kissing attitude therewith.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention.

DESCRIPTION OF THE INVENTION

Figure 1:
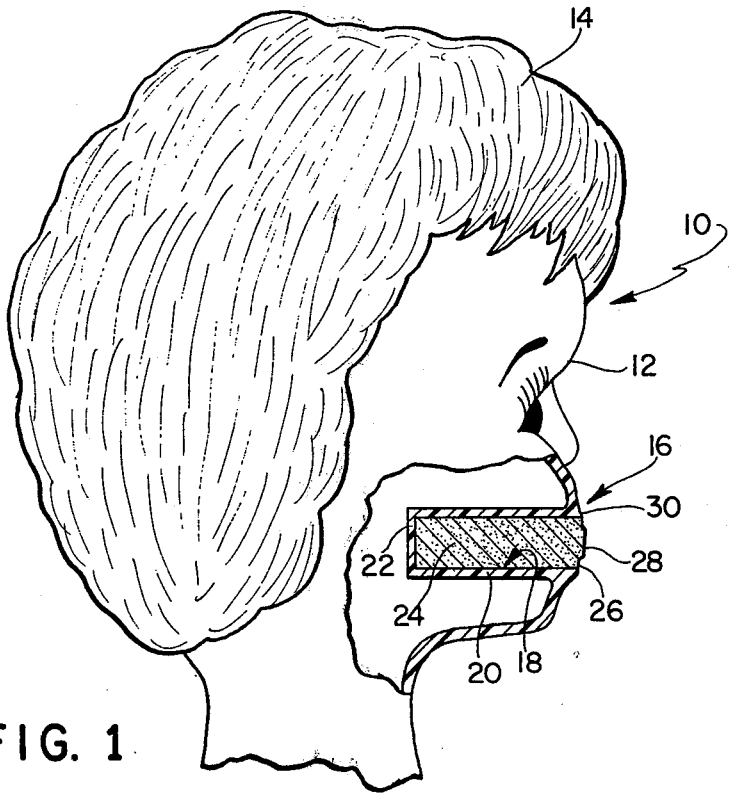
FIG. 1 is a side elevational view of a doll's head incorporating the present invention with parts broken away for clarity.
Figure 2:
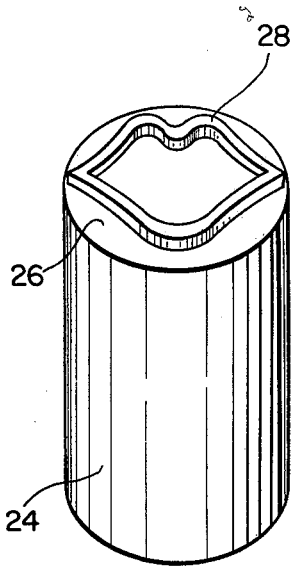
FIG. 2 is a perspective view on an enlarged scale of the porous pad adapted for receiving fluid marking material utilized in the invention.

The present novel doll construction includes an otherwise conventional doll having a generally hollow head 10 including a face 12 and simulated hair 14. The doll head 10 may be formed from any suitable material utilizing conventional processes, such as blow molded vinyl or the like. The oral region 16 of the face 12 is provided with a first cavity 18 inwardly projecting into interior hollow portions of the head. Such cavity 18 is generally defined by imperforate cylindrically shaped sidewalls 20 and a closed end wall 22. The cavity 18 is thus of closed internal configuration but open at the outer or face portion thereof.

A generally cylindrically shaped pad or plug 24 of porous plastic material or of solid marking material is adapted to be received within the cavity 18. The outer face 26 of the pad is provided with integral lip extensions 28 outwardly extending therefrom. Ink or other suitable fluid marking material is impregnated within the pad 24 if the pad is of the aforesaid porous material in such a manner that the pad acts as a reservoir and will continually supply such marking material to the outer surface 26 thereof and particularly to the lip extensions 28. Of course, if the pad is of solid marking material, then no such impregnation is necessary. The positioning of the pad 24 in the cavity 18 is such that the lip extensions 28 project outwardly of those doll face portions 30 adjacent the open end of the cavity 18. The lip extensions are thus available to contact objects when the doll is placed in a kissing attitude therewith such that a lip imprint is left on such object.

Although any suitable marking material may be utilized, it is preferable to use one which is nonstaining so that the marks made thereby may be readily removed, as by water or common solvents. Also, the porous plastic material, where used, is preferably of the type that does not need to be re-wet in order to form an impression, and may be of the type utilized in office supply stamps, identified as "permanent stamps".

Figure 3:
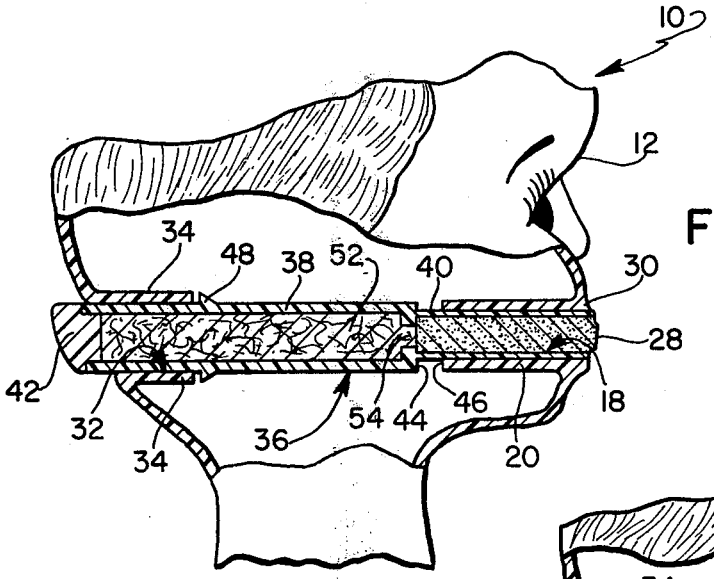
FIG. 3 is a partial elevational view of a doll's head, with portions broken away for clarity, illustrating a further embodiment of the present invention wherein the marking pad is mounted within a member slidably received in the doll's head.
Figure 4:
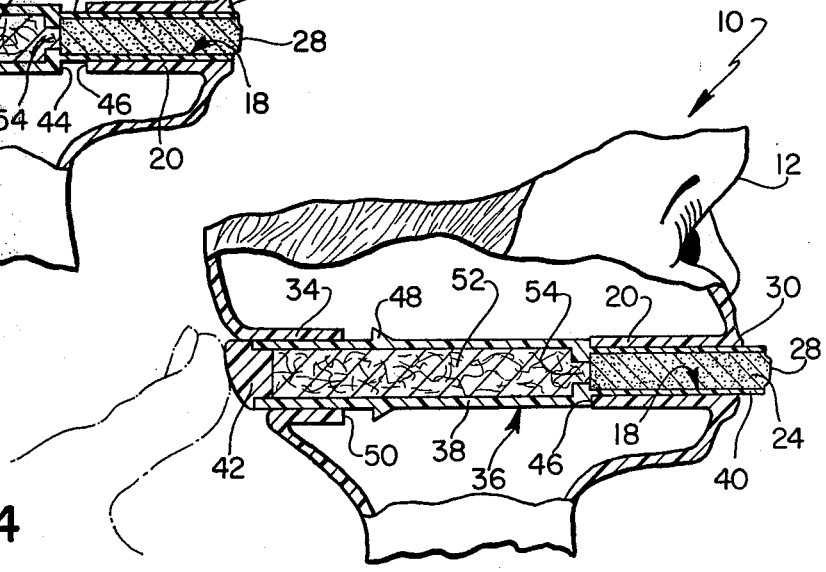
FIG. 4 is a view similar to FIG. 3 but showing the slidable member moved to a foward position so as to increase the force at which the pad contacts objects "kissed" by the doll.

Turning now to FIGS. 3 and 4 of the drawing, an alternate embodiment of the invention is shown for use in those cases where it is desirable to leave a stronger or more positive impression upon the contacted object, either to assure satisfactory contact therewith in the case of objects having an irregular surface, or in order to leave a darker imprint thereon. In such embodiment the cavity 18 is open at both ends thereof and the doll's head 10 is provided with a second cavity 32 formed at the back of the doll's head and generally aligned with the first cavity 18. The second cavity 32 is formed by inwardly directed sidewalls 34. The two cavities are in turn adapted to receive a slidable member 36 generally of hollow cylindrical configuration having a body 38 and an extension 40 outwardly projecting therefrom at the forward end thereof. The extension 40 is in turn adapted to receive the pad 24. The outer surfaces of the member 36 are in slidable contact with the inside surfaces of the sidewalls 20 and 34, respectively.

The rear end of the member 36 is provided with a button or closure element 42 by which the member is adapted to be contacted by the child's finger or thumb so that the member may be forced to the right, as shown in the drawing, so as to project the member outwardly of the doll's face, as best illustrated in FIG. 4. In order to limit the extent to which the member 36 and accordingly the pad 24 may project outwardly from adjacent face portions 30 of the doll, the body 38 is provided with a shoulder 44 adapted to contact inner terminal portions 46 of the sidewalls 20 and thus limit the forward travel of the member. The body is also provided with a radially outwardly extending flange 48 which is similarly adapted to contact inner terminal portions 50 of the sidewalls 34 so as to limit the inward travel of the member 36. Accordingly, when the child wishes to have the doll shown in the FIGS. 3 and 4 embodiment kiss a desired subject, the face of the doll would be moved in contact or close proximity thereto and the slidable member moved to its outer position by the child pushing the button 42. Such action assures that a more positive or darker lip imprint is made upon the object.

Furthermore, the body 38 of the member 36 may be provided with a hollow interior reservoir 52 for receipt of additional fluid marking material. In such cases, the forward end of the body is provided with an opening 54 in communication with the rear portions of the pad 24 so as to facilitate the movement of the marking material held within the reservoir 52 to the pad 24 and thus to the imprinting lip extensions 28 thereof. Ordinarily, to retract the slidable member 36 from its forward position as shown in FIG. 4 of the drawing to its normal position shown in FIG. 3, the child can simply press the forward end of the member to the left either by one's fingers or by pressure application against the object being kissed. Alternately, resilient means (not shown) including springs may be built into the head of the doll so as to constantly resiliently urge the slidable member 36 to its normal position shown in FIG. 3. When such resilient means are utilized, the child simply overcomes the force thereof by pushing the button 42 to the right as shown in FIG. 4.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A doll adapted to simulate kissing by leaving a lip imprint on objects contacted thereby comprising, a head having a face surface, said face surface including an inwardly directed cavity in the oral region thereof, said cavity terminating at an outer open end generally adjacent portions of said face surface, a pad of porous material positioned in said cavity, said pad terminating in an outer surface having lip extensions outwardly projecting therefrom and adapted to contact objects adjacent said face surface, said pad being impregnated with a fluid marking material and acting as a reservoir therefor whereby when said face surface is pressed against any such object, said lip extensions leave a lip imprint of said marking material thereon.

2. The doll construction of claim 1, said lips adapted to project beyond said adjacent face portions.

3. The doll construction of claim 1, wherein said cavity is at least in part defined by imperforate sidewalls connected to said adjacent face positions and inwardly directed therefrom.

4. The doll construction of claim 3, said cavity being closed at its inner end by an end wall connected to said sidewalls, said pad contacting said end wall and said sidewalls.

5. The doll construction of claim 3, said pad adapted for in and out lateral movement with respect to said adjacent face portions.

6. The doll construction of claim 5, said cavity being open at its inner end and said pad slidably positioned therein, and push means mounted in said head for pushing said pad outwardly with respect to said adjacent face portions.

7. The doll construction of claim 6, said cavity being a first cavity, said head being generally hollow and including a second cavity having inwardly directed sidewalls and generally aligned with said first cavity and said push means including a generally longitudinally orientated member mutually supported by said first and second cavity sidewalls, said member having stop means for limiting said in and out lateral movement.

8. The doll construction of claim 7, said stop means including separate stops outwardly projecting from said member at spaced locations in said head, said stops adapted to contact terminal inner portions of said first and second cavity sidewalls to limit the outward and inward movement of said member respectively.

9. The doll construction of claim 8, said member being of hollow generally cylindrical configuration and having means proximal said first cavity for receiving said pad and means at the other end thereof projecting beyond the rear head surface for operative contact with one's finger.

10. The doll construction of claim 9, said member having a marking fluid reservoir, said reservoir communicating with rear portions of said pad.

* * * * *